US006675919B2

(12) United States Patent
Mosing et al.

(10) Patent No.: US 6,675,919 B2
(45) Date of Patent: Jan. 13, 2004

(54) TUBULAR PILING APPARATUS AND METHOD

(75) Inventors: Donald E. Mosing, Lafayette, LA (US); David L. Sipos, Youngsville, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 10/007,291

(22) Filed: Nov. 8, 2001

(65) Prior Publication Data

US 2002/0044839 A1 Apr. 18, 2002

Related U.S. Application Data

(63) Continuation-in-part of application No. 09/499,015, filed on Feb. 4, 2000.

(51) Int. Cl.[7] ..... E21B 17/14; E02D 7/14

(52) U.S. Cl. ..... 175/402; 175/320; 175/405; 405/231; 405/253; 166/358

(58) Field of Search ..... 175/402, 320, 175/325.5, 325.1, 325.3, 325.2, 405; 166/358; 405/253, 254, 184, 232, 231

(56) References Cited

U.S. PATENT DOCUMENTS

| | | | | | |
|---|---|---|---|---|---|
| 982,491 | A | * | 1/1911 | Heggem | 175/402 X |
| 1,110,284 | A | * | 9/1914 | Bienhoff | 175/402 |
| 1,552,755 | A | * | 9/1925 | Pyron | 175/239 |
| 2,795,395 | A | * | 6/1957 | Acker et al. | 175/405 X |
| 3,467,209 | A | * | 9/1969 | Chromy | 175/405 X |
| 3,682,260 | A | * | 8/1972 | Klemm | 175/92 |
| 3,833,075 | A | * | 9/1974 | Bachman et al. | 175/20 |
| 3,878,906 | A | * | 4/1975 | Guest | 175/405 |
| 4,108,256 | A | * | 8/1978 | Moore, III | 175/325.2 X |
| 4,146,098 | A | * | 3/1979 | Cabillo | 175/105 X |
| 4,415,047 | A | * | 11/1983 | Adcock | 175/321 X |
| 4,657,441 | A | * | 4/1987 | Horvath | 405/253 X |
| 4,852,672 | A | * | 8/1989 | Behrens | 175/320 X |
| 5,743,343 | A | * | 4/1998 | Heller et al. | 175/20 |
| 6,035,950 | A | * | 3/2000 | Heller et al. | 175/20 |
| 6,129,163 | A | * | 10/2000 | Hamilton et al. | 175/320 X |

FOREIGN PATENT DOCUMENTS

| | | | | |
|---|---|---|---|---|
| JP | 04261996 | * | 9/1992 | 175/327 |

* cited by examiner

*Primary Examiner*—Jong-Suk(James) Lee
(74) *Attorney, Agent, or Firm*—The Matthews Firm

(57) ABSTRACT

A tubular piling apparatus and method for penetrating the soil comprises, in a preferred embodiment, elements such as a drive shoe and/or other earth displacing structures which may be, in one presently preferred embodiment, of larger outer diameter than the surface conductor pipe. In a preferred embodiment, the invention includes a collar mountable to the pilings having an earth displacing structure formed thereon. In another aspect, a drive shoe, being of a larger size than the conductor pipe and connected to the bottom section of the conductor pipe is provided with an exterior band mounted on the outer diameter of the drive shoe. The exterior band may be located proximate the lower end of the drive shoe. The drive shoe may include teeth formed such that causes compression of earthen formation away from the inner surface of the drive shoe. The drive shoe may also have an inner band, conical surfaces, or other earth displacing structure mounted on the inner surface to further compress the soil away from the interior surface of the drive shoe and/or plurality of piling sections.

60 Claims, 7 Drawing Sheets

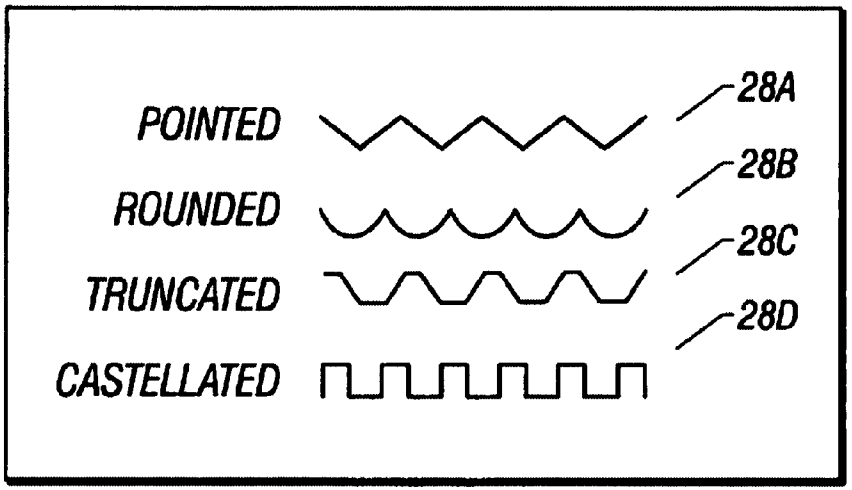
FIG. 4
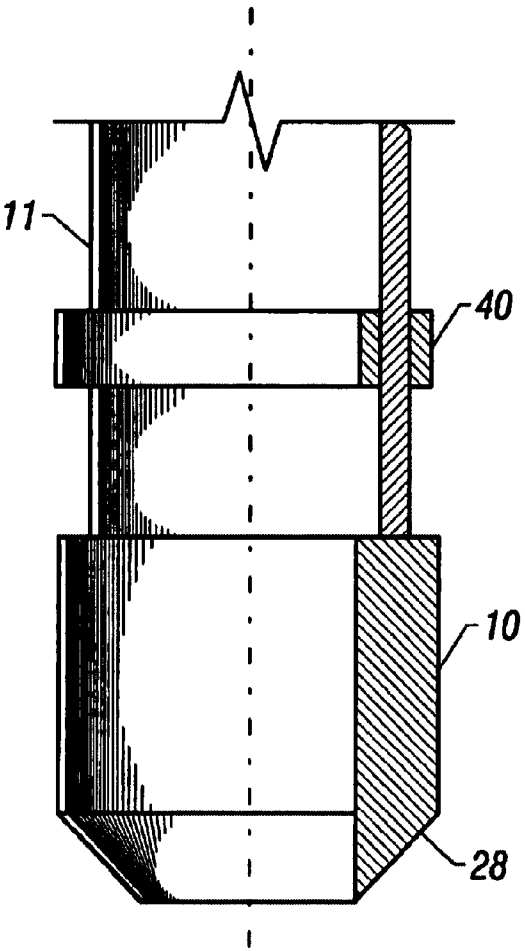

TUBULAR PILING APPARATUS AND METHOD

The present invention is a continuation-in-part of U.S. patent application Ser. No. 09/499,015, filed Feb. 4, 2000.

TECHNICAL FIELD

The present invention relates to an apparatus used in helping penetrate earthen formations, especially subsea soils as encountered in offshore wells, when used in combination with conductor pipe section as such are known in the drilling of wells for hydrocarbons and other fluids.

BACKGROUND ART

It is known, in the drilling of wells for hydrocarbons and other fluids, to drive conductor pipe or tubulars, comprising a string of segments of large diameter tubulars such as conductor pipe, into an earthen formation, especially offshore into the seabed.

As is known in the art, a well bore into an earthen formation provides a cylindrical, continuous casing for drilling of the well. In current practice, conductor pipe is driven from a point below a drilling rig floor to form a continuous string to a point in the earthen formation anywhere to a desired depth. This string of conductor pipe is normally driven by a pile driving apparatus such as a pile driving hammer. The conductor pipe string should be driven in as straight a line as possible since typically the center line of the conductor pipe should be the center line of the well bore for guiding and directing subsequent casing and drilling operations.

A procedure used for driving conductor pipe depends upon numerous factors such as hardness of the earthen formations and the friction on the inner and outer circumference of the pipe which cause increasing resistence to penetration as a conductor pipe is driven into the soil.

U.S. Pat. No. 4,657,441 teaches that soil is compressed and that such compression of the soil is unacceptable when using a drive shoe. The soil is compressed because, as the pipe is driven, both the soil at the inner diameter (ID) of the drive shoe and the soil at the outer (OD) of the shoe are compressed. U.S. Pat. No. 4,657,441 teaches breaking up of the soil by having a series of ribs and a series of spiral inner bar sections on the OD to torsionally disassociate the soil, intermittently de-cohering the soil causing it to break up and become loose.

SUMMARY OF THE INVENTION

An object of this invention to provide an improved drive shoe for use in pile driving surface conductors.

Another object of this invention to provide one or more earth formation structures mountable on the pilings to be driven.

Another object of the invention is to provide a drive shoe with a serrated leading edge with all other surfaces inclined to move the formation away from the drive shoe and following tubular structures to reduce the drag of the formation on the surfaces of the driven piling.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages.

Accordingly, the invention comprises, in one embodiment thereof, a piling assembly to facilitate pile driving a piling into the surface of an earthen formations. The assembly may comprise one or more elements such as, for instance, a plurality of surface conductors comprising an inner conductor surface and an outer conductor surface, a drive shoe having a first end attachable to the plurality of surface conductors and a second end for engaging the earthen formation, and/or at least one conductor earth formation displacing structure for compressing the earthen formation. The conductor earth formation displacing structure may be mounted directly to at least one of the inner conductor surface or the outer conductor surface. The earth formation displacing structure is operable for compressing the earthen formation away from the at least one of the conductor outer surface or the conductor inner surface for enabling enhanced penetration of the plurality of surface conductors into the earthen formation.

The piling assembly may further comprise a collar mountable to the outer conductor surface. In one embodiment, the collar further comprises a first connecting end for connecting to a first of the plurality of surface conductors, and a second connecting end for connecting to a second of the plurality of surface conductors thus forming a joint of the surface conductors. In another embodiment, the collar further comprises an inner surface of the collar mountable between the conductor first end and the conductor second end.

In another embodiment, the invention comprises at least one piling earth formation displacing structure mountable to the outer surface of the surface conductors to extend radially outwardly for compressing the earthen formation during the pile driving.

In another embodiment, the invention comprises a drive shoe with a plurality of different conical surfaces formed therein.

In another embodiment, the invention comprises one or more elements such as, for instance, a tubular body with first and second ends and having an inside diameter smaller and an outside diameter larger than those dimensions for the piling to be driven into the earthen formation, a first conical surface inside the tubular body and opening toward the first end and intersecting an outside surface of the tubular body to define the first end, and/or a plurality of grooves beginning axially outside of or above the first conical surface and cutting into the tubular body and continuing toward the first end to cut into the first conical surface to form a cutting edge at the first end for cutting into the earthen formation.

The grooves may be cut such that surface lines produced are at least forty-five degrees with respect to a flat plane orthogonal to a centerline of the tubular body. In one embodiment, the cutting edge is blunted in a radial dimension thereof ranging in width from one-eighth inch to one-quarter inch. In one embodiment, the invention further comprises a plurality of collars with a diameter approximately the same as the outer diameter of the tubular body such that the plurality of collars being provided at respective joints of the tubular pilings.

A new and improved drive shoe for penetrating the soil is disclosed. The drive shoe, typically fastened below a conductor pipe section, has been found to increase the driveability of a string of conductor pipe by causing soil to be compressed and moved away from the ID and OD of the drive shoe. Moving the soil away from the ID and OD of the drive shoe reduces surface friction on the drive shoe.

In one preferred embodiment, the invention includes a drive shoe that is larger than the conductor pipe and connected to the bottom section of the conductor pipe, and teeth, extending from and forming the bottom of the drive shoe to enhance penetration. In this preferred embodiment, the teeth are formed by first cutting a beveled section from the bottom of the drive shoe where the bevel angles from the OD to the ID of the drive shoe. The teeth are then formed in the beveled bottom such that the interior of the beveled angle causes a compression of the earthen formation away from the ID of the drive shoe.

In an alternative embodiment, the invention may comprise a drive shoe having a larger size OD than the outer diameter of the conductor pipe to which it is attached where the drive shoe is connected to the bottom section of the conductor pipe, and an exterior band that is mounted on or otherwise part of the OD of the drive shoe without the necessity for teeth.

In yet a further alternative embodiment, the invention may comprise a drive shoe having a larger size ID than the inner diameter of the conductor pipe to which it is attached where the drive shoe is connected to the bottom section of the conductor pipe and an interior band that is mounted on or otherwise part of the ID of the drive shoe without the necessity for teeth.

In any embodiment, the drive shoe may further comprise one or more inner bands mounted on or otherwise part of the drive shoe ID to further compress the soil away from the interior surface of the drive shoe. Further, the drive shoe may also have one or more outer bands one or more mounted on or otherwise part of the drive shoe OD to further compress the soil away from the exterior surface of the drive shoe.

This summary is not intended to be a limitation with respect to the features of the invention as claimed, and this and other objects can be more readily observed and understood in the detailed description of the preferred embodiment and in the claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 4 is a perspective view of various embodiments of drive shoe teeth configurations.

GENERAL DESCRIPTION OF PREFERRED MODES FOR CARRYING OUT THE INVENTION

Figure 1A:
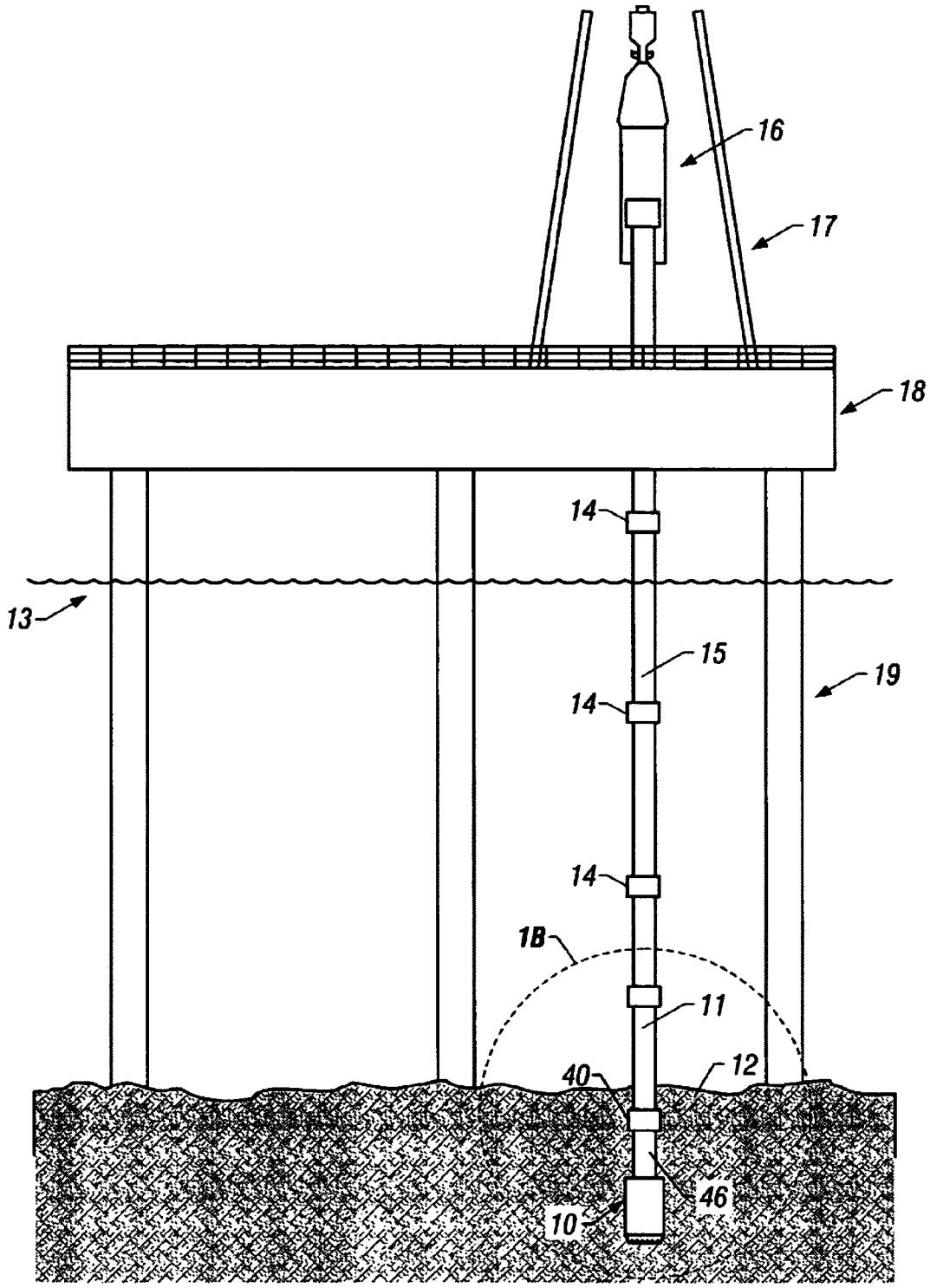
FIG. 1A is a representational view of a typical offshore rig showing a conductor pipe being driven into a subsea earthen formation.

As illustrated in FIG. 1A, a representational view of a typical offshore rig showing a conductor pipe being driven into a subsea, earthen formation, the drive shoe of the present invention, generally illustrated at 10, is connected to conductor pipe 11 being driven into earthen formation 12. Tubular piling or conductor pipe 11 forms a continuous string 15 driven by a suitable pile driving and/or hammer apparatus 16 mounted on a suitable offshore drilling structure generally illustrated at 17, which is mounted on offshore drilling rig 18 with supporting legs or structure as at 19 for drilling into earth formation 12 beneath the surface of water 13.

Conductor pipe string 15 forms an outer casing and must be driven deeply enough in earthen formation 12 for eliminating erosion, blow outs, or other pressures that may later be encountered within the well bore. Such conductor pipe 15 is typically driven to a satisfactory point which may be one hundred feet or several hundred feet through earthen formation 12. It should be evident to those skilled in the well drilling art that significant forces are exerted by the resistence of earth formation 12. Accordingly, the purpose of drive shoe 10 is to enhance penetration of conductor pipe 11 as it is driven. Oversize bands 14 distributed about the length of the piling 15 may improve penetration during pile driving. Soil pushed away from the tubular surface of the conductor pipe by drive shoe 10 and attached band 40, may be induced back by the impact of pile driving. Utilizing bands 40 positioned along conductor/piling tubular 15, pushes the soil away from the surface of piling 15. To that end, pipe joint connections with oversize bands 14 may be utilized to expand the hole to the diameter of hole formed by the lower end of drive shoe 10. While the bands may be welded, they may also be provided on couplings between the tubular piling sections. Where couplings are utilized to provide the oversized bands, a distribution of about forty feet between bands or other distribution may provide faster penetration.

Figure 1B:
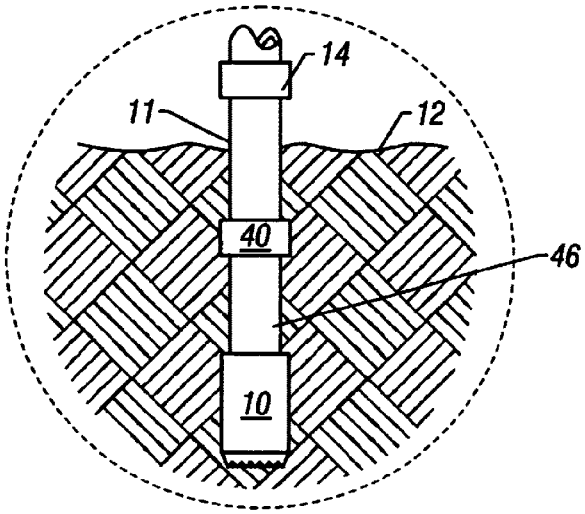
FIG. 1B is a close up representational view of one embodiment of a drive shoe attached to conductor pipe.

FIG. 1B is a close up view of drive shoe 10 embedded in earth formation 12.

Figure 2:
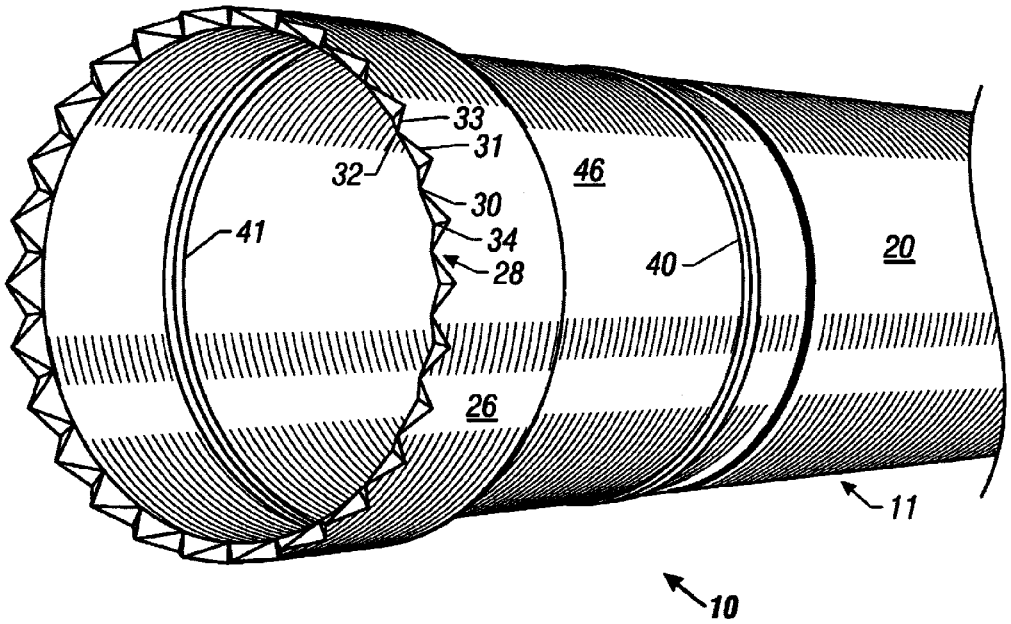
FIG. 2 is a perspective view of one embodiment of a drive shoe mounted with conductor pipe.
Figure 3:
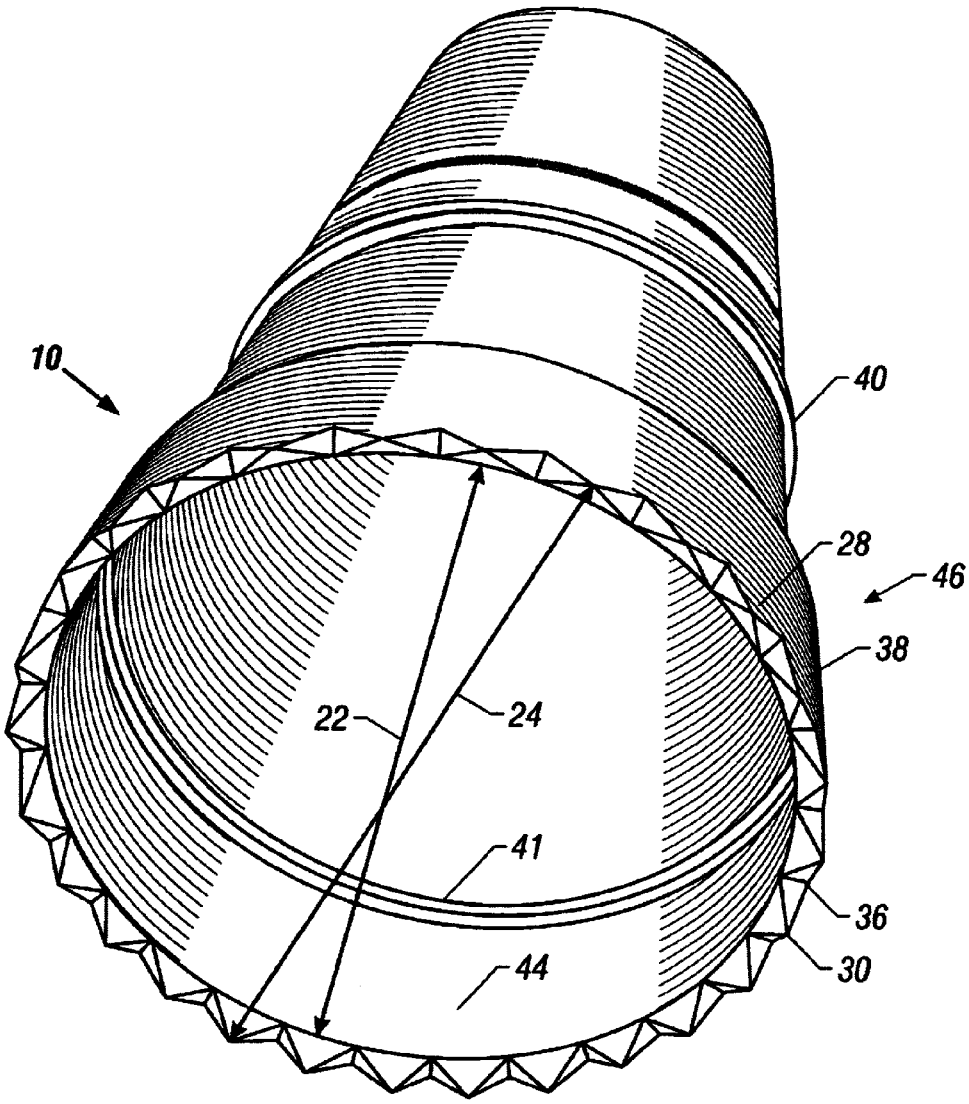
FIG. 3 is a different perspective view of the embodiment of FIG. 2 showing the interior of that embodiment of the drive shoe with interval beveled bottom teeth.
Figure 5:
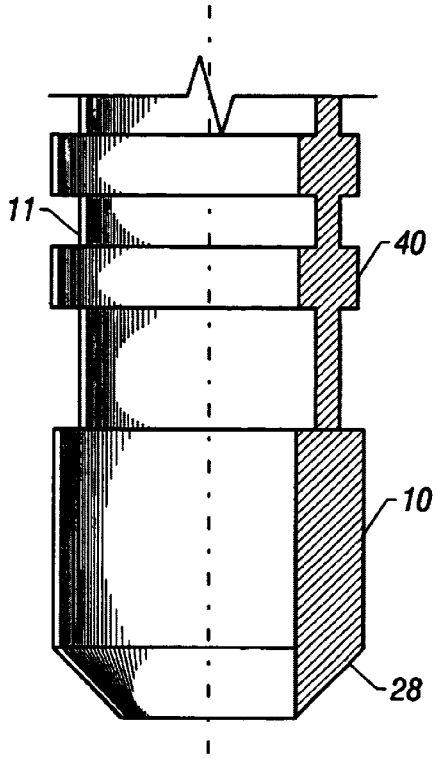
FIG. 5 is a view of a drive shoe wherein a plurality of outer bands are integral to the drive shoe and/or conductor of FIG. 4 in accord with one embodiment of the invention.

Referring now to FIG. 2, a partial cross-sectional view of an embodiment of drive shoe 10 mounted with conductor pipe 11, and FIG. 3, a cross section of FIG. 2 showing the interior of an embodiment of drive shoe 10 with interval beveled teeth 28, drive shoe 10 may, if desired, have a larger inner and/or outer diameter than conductor pipe 11 to which drive shoe 10 is attached.

Figure 6:
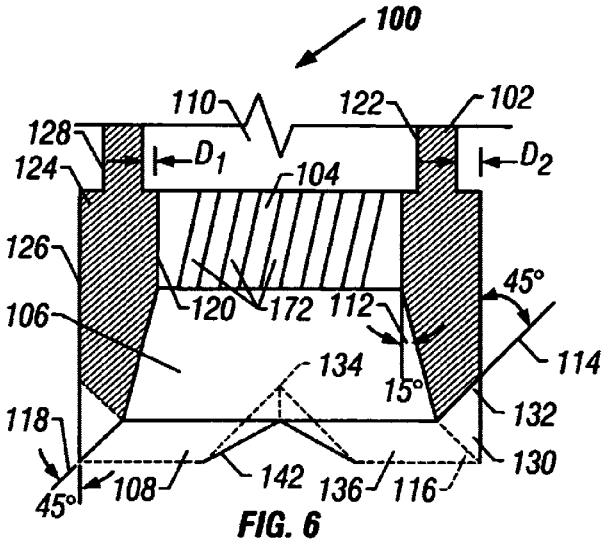
FIG. 6 is an elevational view, in section and partially cut-away, of a presently preferred embodiment of the present invention.

In one embodiment, drive shoe 10 is fixedly attached to lower end 20 of conductor pipe 11 such that inner diameter (ID) 22 (see FIG. 3) of drive shoe 10 is less than the interior diameter (not numbered in the figures) of conductor pipe 11 and outer diameter (OD) 24 of drive shoe 10 is greater than the exterior diameter (not numbered in the figures) respectively. However, in other embodiments, inner diameter 22 of drive shoe 10, or portions thereof, may be greater than the interior diameter of conductor pipe 11. In other embodiments, one or more inner bands, such as inner band 41 may have an inner diameter less than the inner diameter of conductor pipe 11. If inner diameter 22 is greater than the interior diameter of conductor pipe 11, then the inner diameter of band 41 may be either less than or greater than the interior diameter of conductor pipe 11. Moreover, if inner diameter 22 is less than the interior diameter of conductor pipe 11, then an inner groove or conical enlargement may have an inner diameter greater than the conductor pipe. Such a variation is shown in FIG. 6 which is discussed in more detail hereinafter.

Drive shoe 10, or portions thereof, may be thicker than the bottom end of conductor pipe 11 and therefore may be substantially stronger and more deformation resistant. Drive shoe 10 is fixedly attached to conductor pipe 11 by any suitable means such as welding, threads, welding and threads, collars, welded collars, one piece machining, or by any other means. Exterior surface 46 of on the upper portion of drive shoe 10 may have the same outer diameter as lower end 20 of conductor string 11. Alternatively, exterior surface 46 may have a larger diameter than lower end 20 of conductor string 11.

In a preferred embodiment, lower end 26 of drive shoe 10 may include a series of saw teeth, generally indicated at 28. The lowest portion of saw teeth 28, illustrated at 30, ends at intersection 32 formed by edges 31 and 33 to form the "saw tooth" configuration. Lower end 26 may be beveled on ID 24, the beveling, generally indicated at 34, preferably having a forty five degree angle although the angle may vary from twenty to eighty degrees. Typically, lower end 26 is first beveled and then saw teeth 28 cut into lower end 26 of drive shoe 10 such that lower end 26 has projecting, formed teeth 28 on OD 24 but an interior beveled surface such as 34 such that teeth 28 are slanted from point 36 forty-five degrees outwardly to the tip of lowest portion 30. In this manner, the thickness of teeth 28 at point 36 is the wall thickness 38 of drive shoe 10 and the thickness of drive shoe 10 decreases from point 36 to lowest portion 30 of teeth 28.

As shown in FIG. 4, teeth 28 may have numerous patterns as will be familiar to those skilled in the drive shoe arts, including byway of example and not limitation pointed 28A, round 28B, truncated 28C, castellated 28D, or the like, or any combination thereof.

As also illustrated, exterior band 40 for increasing at least a portion of OD 24 may be mounted on OD 24 of the drive shoe 10 by any suitable manner, such as welding to the external surface of drive shoe 10, forming exterior band 40 into OD 24, or other manners known to those skilled in the tubular arts. In addition, it should be understood that interior band 41, shown in FIG. 2 and FIG. 3, may be similarly formed or attached to ID 22 of drive shoe 10 to decrease ID 22 at the location of interior band 41. It also should be understood that more than one exterior band 40 or other structure for increasing OD 24 may be formed in or on or attached to the outer surface of drive shoe 10, and that more than one interior band 41 or other structure for decreasing ID 22 may be formed in or on or attached to the inner surface of drive shoe 10.

Further, it is within the contemplation of the present invention that OD 24 alone may be larger than the outer diameter of conductor pipe 11 to which drive shoe 10 is attached. It is further within the contemplation of the present invention that ID 22 alone may be larger than the inner diameter of conductor pipe 11 to which drive shoe 10 is attached. It is further still within the contemplation of the present invention that interval beveled teeth 28 may, if desired, be omitted. OD 24 may be larger than the outer diameter of conductor pipe 11 and ID 22 may be less than the interior diameter of conductor pipe 11. In these embodiments, soil may be compressed externally and/or internally by the disparity in diameter, especially in the presence of exterior band 40 and/or interior band 41.

In the operation of the preferred embodiment, drive shoe 10 is attached, by way of example and not limitation, such as by welding to lower end 20 of conductor pipe 11. In a typical mode of operation, conductor string 15 is continually hammered by pile driving apparatus 16 to drive conductor pipe 11 into earth formation 12. As conductor string 15 is so driven, saw teeth 28, because of their structure, penetrate through earth formation 12 and force soil inwardly while at the same time compressing soil to reduce the resistence away from interior surface 44 of drive shoe 10.

In an alternative embodiment, an inner band 41 or series of inner bands 41 or any other similar structure that would further compress soil interiorly into drive shoe 10 further compresses the soil to move it away from interior surface 44 of drive shoe 10. In a further alternative embodiment, an exterior band 40 or series of exterior bands 40 or any other structure that would further compresses soil exteriorly away from drive shoe 10 further compress the soil to move it away from exterior surface 46 of drive shoe 10.

In FIG. 6, a presently preferred drive shoe 100. Drive shoe 100 has an upper bore 104. Upper bore 104 of drive shoe 100 opens up into middle portion bore 106 of drive shoe 100 which in turn opens up into lowermost bore 108 of drive shoe 100. In one embodiment, middle portion bore 106 is conical and may expand with axial distance moving closer to the bottom of drive shoe 100. Middle portion bore may have an inner angled surface 114 having a presently preferred angle 112 of fifteen degrees with an axis of drive shoe 100. However, angle 112 may vary in a range at least from about zero to thirty degrees. Lower bore 108 is also conical and has inner surface 116 which preferably has a larger angle 118 of about forty to forty-five degrees with respect to an axis of drive shoe 100. However, angle 118 could also vary in a range at least from about zero to one hundred thirty-five degrees.

Drive shoe 100 is shown connected/attached/welded with another tubular section 102 which maybe the lower end of piling 11 or may be the upper end of drive shoe 100. Surface 120 may be the same inner and/or outer diameter as that of piling 11. Surface 120 defines an inner diameter that is smaller than an inner diameter of surface 122. A lower portion of surface 114 and, in this example, all of surface 116 defines an inner diameter of drive shoe 100 that is larger than the inner diameter of surface 120. Thus, section 124 effectively defines an inner band having an interior diameter smaller than the diameter of surface 122 which may be the same inner diameter as that of piling 11. Outer surface 126 of drive shoe 100 is greater in diameter than surface 128 which may be the same outer diameter as piling 11. Thus, drive shoe 100 has a smaller bore and larger major diameter than the bore and outer diameter of the tube to be fitted to drive shoe 100. While inner surface 120 and outer surface 126 is shown as relatively smooth and circular with constant outer diameter at any axial position, any desired earth displacing structure could be utilized, such as circumferential bands, grooves 172 of any type in any direction such as spiraling, straight, angled, and the like, protrusions, bevels, conical surfaces, and the like.

Figure 7:
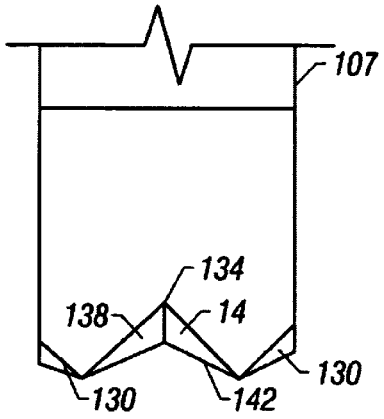
FIG. 7 is an elevational view, of the embodiment of FIG. 6 but not cut away.
Figure 8:
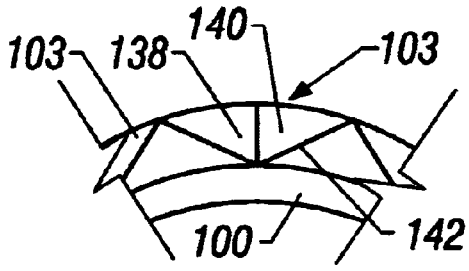
FIG. 8 is a partial end view projected from FIG. 7.

Notches 130 may preferably be equally distributed about the periphery of the lower end of drive shoe 100 as shown in FIG. 6, FIG. 7, and FIG. 8. In one embodiment, notches 130 are cut at an angle of forty-five degrees with respect to an axis of the drive shoe as shown by angle 132. Top 134 of the cut of notches 130 may begin above bore 108 and extend all the way to bottom or cutting end 136 of drive shoe 100. Notches 130 form a serpentine path as viewed either from the side view of FIG. 6 and FIG. 7 or the end of drive shoe 100 as shown in FIG. 8. In this embodiment, each notch may have two outer surfaces 138 and 140.

Multi-faceted cutting edge 142 is defined by notches 138 along bottom or cutting end 136. Cutting end 136 and/or edge 142 may be toughened by dulling the cutting edges 142 thereof. The more rocky the formation to receive pilings, the wider should be the dulled surface. Dulling surfaces on cutting edges 142 may be typically range from about one-sixteenth to one-eight inch in width.

Figure 9:
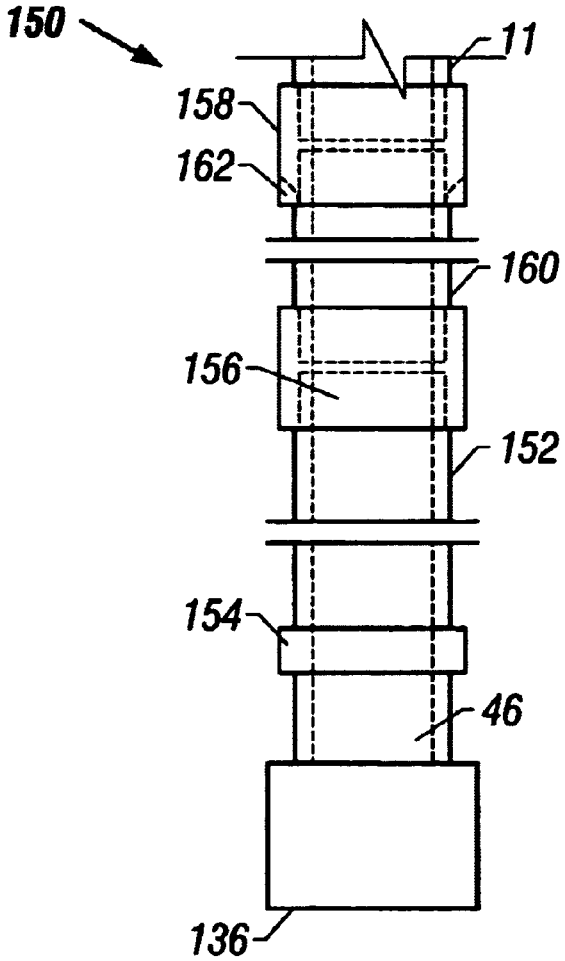
FIG. 9 is an elevational view, partially in phantom lines, of a presently preferred embodiment of a tubular piling/conductor assembly usable with a drive shoe in certain earth formations.

FIG. 9 shows a presently preferred piling assembly 150 arranged to keep the soil pushed away from the outer piling surface 152. First compression ring 154 may preferably be about two drive shoe diameters above drive shoe end 136. First compression ring may be comprised of a collar that is mountable between the ends of any pipe section. First pipe compression ring 156 may be positioned about one-half pipe section (or typically about twenty feet) above drive shoe end 136. First pipe compression ring 156 may be comprised of a collar that may be constructed with opposite ends each connectable to a respective pipe section such that first compression ring 156 forms a joint or is mountable at the joint of two respective pipe sections. Second pipe compression ring may be positioned about three-fourths of a pipe section (or typically about thirty feet) above drive shoe end 136. Other compression rings may be one pipe section length (about forty feet) apart. If greater vibration occurs in some fields due to pile driving, then the rings can be closer together or that the lower rings, 154, 156, and 158, at a minimum, or closer together.

While compression rings or collars 154, 156, and 158 have inner and outer surfaces that may relatively smooth and circular with constant outer diameter at any axial position, any desired earth displacing structure could be utilized, such as circumferential bands, grooves of any type in any direction such as spiraling, straight, angled, and the like, protrusions, bevels, conical surfaces, and the like, mounted inside or outside the tubular pilings to be pile driven.

While collars are readily and easily attachable to the tubular pilings, such as by welding, other constructions could also be utilized such as sectional elements, or the like, that do not necessary encompass the entire circumference of the tubular pilings. Moreover, collars 154, 156, and 158 may be formed of sections, hinges, latches, and the like for mounting thereon which may also aid in any welding, brazing, soldering, or any other means for mounting.

Thus, in one preferred embodiment, compression rings, such as compression rings 156 and 158 and other compression may be formed as collars whereby two tubulars are joined therewith. For example, tubular piling section 152 and tubular piling section 160 are joined by collar 156 which is formed having an oversize outer diameter. Alternatively, rings can be welded, mounted, or otherwise connected to an outer surface of tubulars such as ring 154 mounted at any axial position between the ends of a tubular conductor.

If desired, collars such as collar 158 can be beveled as indicated in dashed lines to form bevel 162 at a lower end of one or more collars. The collars could also be notched or provided with teeth in some manner such as the notching or teeth discussed above.

Figure 10:
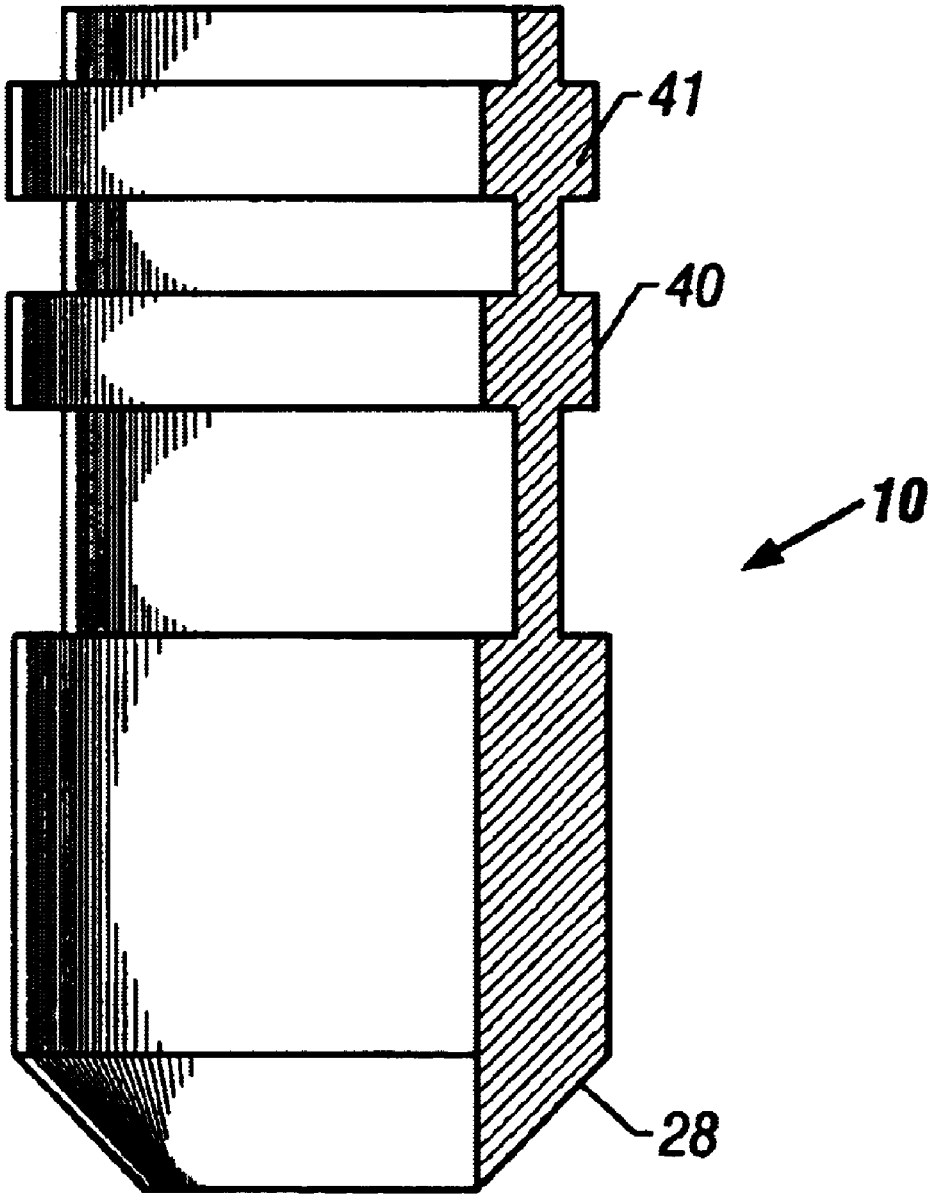
FIG. 10 is an elevational view, partially in section, of yet another embodiment of a drive shoe.

In FIG. 10, it can be seen that rings 40 and 41 may be formed integrally as part of drive shoe 10, if desired. This one piece construction or can be achieved by welding or other manners of construction, if desired.

In operation, as drive shoe 10 is being driven with piling 11 and penetrating earth formation 12, outer diameter of drive shoe 10 preferably forms a larger diameter hole than piling 11 such that earth formation 12 may be compressed away from exterior surface 46. To prevent the earth from coming back inwardly as piling 11 is driven into the ground, exterior bands 154, 156, 158 and other bands may be used to compress soil away from exterior surface 152 of conductor 11.

At the drive shoe level, in the embodiment where ID 22 is larger than the inner diameter of conductor pipe 11, earth formation 12 may be compressed away from interior surface 46 by inner band 41. The various types of notching and teeth may be used as desired to further improve movement of soil away from pipe 11.

Thus, in any one of the manners discussed herein or in any combination thereof, enhanced penetration of drive shoe 10 and conductor string 11 into earth formation 12 is achieved.

It may be seen from the preceding description that a new and improved drive shoe has been provided. Although very specific combination examples have been described and disclosed, the invention of the instant application is considered to comprise and is intended to comprise any equivalent structure.

The foregoing disclosure and description of the invention is therefore illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be greatly different from that shown and still operate well within the spirit of the invention as described hereinbefore and in the appended claims. It will be seen that various changes and alternatives may be used that are contained within the spirit of the invention. Moreover, it will be understood that various directions such as "upper", "lower", "bottom", "top", "left", "right", and so forth are made only with respect to easier explanation in conjunction with the drawings and that the components may be oriented differently, for instance, during transportation and manufacturing as well as operation. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A drive shoe assembly for pile driving surface conductor tubulars into an earthen formation so that said surface conductor tubulars are permanently positioned in said earthen formations, comprising:

a tubular drive shoe having a first end suitable for attachment to said surface conductor tubulars, said tubular drive shoe having a second end, said drive shoe and said surface conductor tubulars in combination defining an inner surface and an outer surface;

an earth formation displacing structure for compressing said earthen formation, said earth formation displacing structure disposed proximate at least one of said outer surface or said inner surface, said earth formation displacing structure comprising at least one circumferential band; and said earth formation displacing structure compresses said earthen formation away from said at least one of said outer surface or said inner surface for enabling enhanced penetration of said tubular into said earthen formation.

2. The assembly as set forth in claim 1 wherein said first end is attached to said surface conductor tubulars so as to be permanently implanted within said earth formation.

3. The assembly as set forth in claim 2 wherein said earth formation displacing structure includes a plurality of circumferential bands.

4. The assembly as set forth in claim 1 wherein said at least one circumferential band is fixedly attached to said outer surface.

5. The assembly as set forth in claim 4 wherein said at least one circumferential band is welded to said outer surface.

6. The assembly of claim 1 further comprising a bevel on a lower side of said at least one circumferential band.

7. The assembly as set forth in claim 1 wherein an earth formation displacing structure for compressing said earthen formation, said earth formation displacing structure disposed proximate to each said outer surface and said inner surface, said earth formation displacing structure comprising at least one circumferential band; and said earth formation displacing structure compresses said earthen formation away from said each said outer surface and said inner surface for enabling enhanced penetration of said tubular into said earthen formation.

8. The assembly as set forth in claim 1 wherein the earth formation displacing structure for compressing said earthen formation, said earth formation displacing structure disposed proximate to each said outer surface and said inner surface, said earth formation displacing structure comprising at least two circumferential bands; and said earth formation displacing structure compresses said earthen formation away from said each said outer surface and said inner surface for enabling enhanced penetration of said tubular into said earthen formation.

9. An apparatus for pile driving surface conductor tubulars into an earthen formation so said surface conductor tubulars are permanently positioned in said earthen formations, comprising:

a drive shoe having an inner surface, an outer surface, a first end suitable for attachment to a surface conductor tubular so as to be permanently implanted within said earthen formation, and a second end;

said inner surface being smaller in diameter than an inner surface diameter of said surface conductor tubular to which said drive shoe is attached, said inner surface having a first inner portion thereof being continuous so as to be of a constant inner diameter around a circumference thereof without protrusions or grooves on said first inner portion of said inner surface; and said outer surface being larger in diameter than said surface conductor tubular to which said drive shoe is attached, said outer surface having a first outer portion thereof being continuous so as to be of a constant outer diameter around a circumference thereof without protrusions or grooves on said first outer portion of said outer surface.

10. The apparatus as set forth in claim 9 wherein an earth formation displacing structure for compressing said earthen formation is affixed to at least one of said inner surface or said outer surface such that said earth formation displacing structure is disposed adjacent of said first inner portion and said first outer portion.

11. The apparatus as set forth in claim 10 wherein said earth formation displacing structure includes at least one circumferential band.

12. The apparatus as set forth in claim 11 wherein said at least one circumferential band is fixedly attached to said inner surface of said drive shoe.

13. The apparatus as set forth in claim 11 wherein said at least one circumferential band is welded to said outer surface of said drive shoe.

14. The apparatus of claim 9 further comprising a beveled surface disposed at said second end such that said beveled surface extends from said inner surface to said outer surface.

15. The apparatus as set forth in claim 9 wherein an earth formation displacing structure for compressing said earthen formation is affixed to at each of said inner surface and said outer surface such that said earth formation displacing structures are disposed adjacent of said first inner portion and said first outer portion.

16. The apparatus as set forth in claim 15 wherein said earth formation displacing structures include at least one circumferential band.

17. The apparatus as set forth in claim 9 wherein an earth formation displacing structure for compressing said earthen formation is affixed to at each of said inner surface and said outer surface such that said earth formation displacing structures are disposed adjacent of said first inner portion and said first outer portion; and said earth formation displacing structures include at least two circumferential bands.

18. A drive shoe assembly for the advancing end of pile-driven tubular pilings, said pile-driven tubular pilings having an inner diameter and an outer diameter, said drive shoe assembly comprising;

a tubular body with first and second ends, said tubular body having an inner surface and an outer surface, said first end being connectable with said pile-driven tubular pilings;

a first conical portion of said inner surface of said tubular body, said first conical portion having a first sloping surface with at least one angular slope greater than zero degrees with respect to an axis through said tubular body; and a second conical portion of said inner surface having a second sloping surface with at least one angular slope greater than zero degrees with respect to an axis through said tubular body, said at least one angular slope of said second sloping surface being different than said at least one angular slope of said first sloping surface.

19. The drive shoe assembly of claim 18, further comprising:

said second conical portion being adjacent said second end, and a plurality of teeth disposed about said second end, said plurality of teeth intersecting said second sloping surface.

20. The drive shoe assembly as set forth in claim 18, further comprising:

a plurality of teeth forming cutting surface formed on said second end, said cutting surface being blunted by a radial dimension ranging from one-eighth to one-quarter inches.

21. The drive shoe assembly as set forth in claim 18 wherein said inner surface of said tubular body has at least a portion thereof with an inner diameter smaller than said inner diameter of said pile-driven tubular pilings.

22. The drive shoe assembly of claim 18 wherein said first conical portion intersects said second conical portion.

23. The drive shoe assembly of claim 18 further comprising at least one continuous band disposed about said tubular body or about said pile-driven tubular pilings.

24. The drive shoe assembly of claim 18 further comprising at least one continuous band disposed about said inner surface and said outer surface of said tubular body or about said outer surface of said pile-driven tubular pilings.

25. A drive shoe assembly for pile driving surface conductor tubulars into an earthen formation so said surface conductor tubulars are permanently positioned in said earthen formations, comprising:

a drive shoe having a first end suitable for attachment to a tubular, and a second end, said drive shoe and said surface conductor tubulars in combination defining an inner surface and an outer surface; and at least one earth formation displacing structure for compressing said earthen formation, said at least one earth formation displacing structure disposed proximate at least one of said outer surface or said inner surface, said at least one earth formation displacing structure being continuous around a respective circumference of said outer surface or said inner surface.

26. The assembly as set forth in claim 25, wherein said at least one earth formation displacing structure for compressing said earthen formation is integral with said outer surface.

27. The assembly as set forth in claim 25, wherein said at least one earth formation displacing structure includes at least one circumferential band.

28. The assembly as set forth in claim 27, wherein said at least one circumferential band is fixedly attached to said outer surface of said drive shoe.

29. The assembly as set forth in claim 27, whrein said at least one circumferential band is fixedly attached to said inner surface.

30. The assembly as set forth in claim 25, further comprising a plurality of teeth machined into said second end so as to be integral therewith.

31. The assembly as set forth in claim 25, wherein said second end is beveled at an angle projecting inwardly from said outer surface to said inner surface.

32. The assembly as set forth in claim 31, wherein said angle is between twenty degrees and eighty degrees.

33. The assembly as set forth in claim 32, wherein said angle is forty five degrees.

34. The assembly of claim 25, further comprising a plurality of castellated teeth disposed about said second end.

35. The assembly of claim 25, further comprising a plurality of pointed teeth disposed about said second end.

36. The assembly of claim 25, further comprising a plurality of pointed teeth disposed about said second end wherein each tooth is triangular with straight edges.

37. The assembly of claim 25, wherein an outer diameter of said at least one earth formation displacing structure id larger then an outer diameter of said tubular to which said drive shoe is attached at said first end.

38. The drive shoe of claim 25, wherein an inner diameter of said first end is larger than an inner diameter of said tubular to which said drive shoe is attached at said first end.

39. The drive shoe of claim 25, wherein said tubular to which said drive shoe is attached is a conductor pipe.

40. The assembly as set forth in claim 25, further comprising more than one earth formation displacing structure for compressing said earthen formation, said more than one earth formation displacing structure disposed proximate each of said outer surface and said inner surface, said more than earth formation displacing structure being continuous around a respective circumference of said outer surface and said inner surface.

41. The assembly as set forth in claim 40, wherein said more than one earth formation displacing structure for compressing said earthen formation is integral with said outer surface and/or said inner surface.

42. The assembly as set forth in claim 40, wherein said more than one earth formation displacing structure includes more than one circumferential band.

43. The assembly as set forth in claim 42, wherein said at more than one circumferential band is fixedly attached to said inner surface and the outer surface.

44. A piling to be pile driven into the surface of an earthen formation prior to drilling operations, said piling to be permanently installed within said earthen formation during said drilling operations, said piling comprising:

a plurality of surface conductors;

a drive shoe having a first end attached to said plurality of surface conductors, said drive shoe having a second end for engaging said earthen formation, said drive shoe and said plurality of surface conductors comprising an inner surface and an outer surface; and a circumferential band affixed to at least one of said inner surface or said outer surface.

45. The piling of claim 44 wherein the second end further comprises a plurality of teeth, the teeth substantially reducing resistance of the drive shoe penetrating the earthen formation, the teeth comprising a bevel from the outer surface to the inner surface.

46. The piling of claim 45 wherein the bevel has an angle from the outer surface to the inner surface.

47. The piling of claim 46 wherein the angle is between twenty degrees and eighty degrees.

48. The piling of claim 44 wherein the circumferential band affixed to each one of said inner surface and said outer surface.

49. A piling assembly to facilitate pile driving a piling into the surface of an earthen formations, said piling assembly comprising:

a plurality of surface conductors, said plurality of surface conductors comprising an inner conductor surface and an outer conductor surface;

a drive shoe having a first end attachment to said plurality of surface conductors, said drive shoe having a second end for engaging said earthen formation; and at least one conductor earth formation displacing structure for compressing said earthen formation, said at least one conductor earth formation displacing structure being mounted to at least one of said inner conductor surface or said outer conductor surface, said earth formation displacing structure being operable for compressing said earthen formation away from said at least one of said conductor outer surface or said conductor inner surface for enabling enhanced penetration of said plurality of surface conductors into said earthen formation.

50. The piling assembly of claim 49, wherein said at least one conductor earth formation displacing structure further comprises:

a collar mountable to said outer conductor surface.

51. The piling assembly of claim 50, wherein said collar further comprises:

a first connecting end for connecting to a first of said plurality of surface conductors, and a second connecting end for connecting to a second of said plurality of surface conductors.

52. The piling assembly of claim 50, wherein each of said plurality of surface conductors has a conductor first end and a conductor second end, said collar further comprising:

an inner surface of said collar being mountable between said conductor first end and said conductor second end.

53. The piling assembly of claim 49 further comprising more than one conductor earth formation displacing structure for compressing said earthen formation wherein:

said more than one conductor earth formation displacing structure being mounted to each one of said inner conductor surface and said outer conductor surface;

said earth formation displacing structures being operable for compressing said earthen formation away from each said at least one of said conductor outer surface and said conductor inner surface for enabling enhanced penetration of said plurality of surface conductors into said earthen formation.

54. An apparatus to facilitate pile driving a piling into the surface of an earthen formations, said piling comprising a plurality of piling sections connectable together, each piling section having an outer surface, a drive shoe connected to an end of said plurality of piling sections, said apparatus comprising:

at least one piling earth formation displacing structure mountable to said outer surface, said at least one piling earth formation displacing structure extending radially outwardly for compressing said earthen formation during said pile driving, said at least one piling earth formation displacing structure being operable for compressing said earthen formation away from said outer surface for enabling enhanced penetration of said plurality of surface conductors into said earthen formation.

55. The apparatus of claim 54, wherein said at least one piling earth formation displacing structure comprises a collar for mounting to said outer surface.

56. A drive shoe assembly for facilitating pile driving of tubular pilings into an earthen formation, said drive shoe assembly comprising:

a tubular body, with first and second ends, having an inside diameter smaller and an outside diameter larger than those dimensions for the piling to be driven into said earthen formation;

a first conical surface inside said tubular body, opening toward said first end and intersecting an outside surface of said tubular body to define said first end; and a plurality of grooves having a beginning at an axial position along said tubular body outside of an axial span of said first conical surface and cutting into said tubular body, said plurality of grooves extending toward said first end to cut into said first conical surface to form a cutting edge at said first end for cutting into said earthen formation.

57. The drive shoe assembly of claim 56, further comprising:

said grooves being cut such that surface lines produced are at least forty-five degrees with respect to a flat plane orthogonal to a centerline of said tubular body.

58. The drive shoe assembly of claim 56, further comprising:

said cutting edge being blunted in a radial dimension thereof ranging in width from one-eighth inch to one-quarter inch.

59. The drive shoe assembly of claim 56, further comprising:

a plurality of collars with a diameter approximately the same as said outer diameter of said tubular body, said plurality of collars being provided at respective joints of said tubular pilings.

60. The drive shoe assembly of claim 56, further comprising:

a second conical surface with an increasing diameter toward said first end.

* * * * *